US005112160A

United States Patent [19]

Jensen et al.

[11] Patent Number: 5,112,160

[45] Date of Patent: May 12, 1992

[54] ROCK ANCHOR

[75] Inventors: Erik D. Jensen, Helderkruin; Richard R. Wood, Randpark Ridge, both of South Africa

[73] Assignee: Delkor Technik Limited, Transvaal, South Africa

[21] Appl. No.: 385,812

[22] Filed: Jul. 26, 1989

[30] Foreign Application Priority Data

Jul. 26, 1988 [ZA] South Africa ..... 88/5434
Aug. 4, 1988 [ZA] South Africa ..... 88/5720

[51] Int. Cl.[5] ..... E21D 21/00

[52] U.S. Cl. ..... 405/259.5; 405/259.1; 411/65; 411/77

[58] Field of Search ..... 405/259, 260; 411/63-67, 77

[56] References Cited

U.S. PATENT DOCUMENTS

| | | | |
|---|---|---|---|
| 1,848,142 | 3/1932 | Peirce | 411/64 |
| 2,804,797 | 9/1957 | Seely . | |
| 3,128,666 | 4/1964 | Baker | 411/63 |
| 3,455,200 | 7/1969 | Cumming . | |
| 3,797,254 | 3/1974 | Askey et al. | 405/259 |
| 4,092,814 | 6/1988 | Kern | 405/260 X |
| 4,312,604 | 1/1982 | Fu et al. | 405/259 |

FOREIGN PATENT DOCUMENTS

| | | | |
|---|---|---|---|
| 0064362 | 11/1982 | European Pat. Off. | 405/259 |
| 1085480 | 7/1960 | Fed. Rep. of Germany . | |
| 1110591 | 7/1961 | Fed. Rep. of Germany . | |
| 1127847 | 4/1962 | Fed. Rep. of Germany | 405/259 |
| 2412459 | 9/1975 | Fed. Rep. of Germany . | |
| 3309006 | 9/1984 | Fed. Rep. of Germany . | |
| 8802437 | 4/1988 | PCT Int'l Appl. | 405/259 |

*Primary Examiner*—Dennis L. Taylor
*Attorney, Agent, or Firm*—McGlew & Tuttle

[57] ABSTRACT

This invention relates to a rock anchor which includes an elongated element which is composed of a plurality of elongated tension members which are arranged around the long axis of the elongated element in a circumferential spaced relationship to provide a passage through the elongated element, slots between the tension members which extend over the length of the elongated element, an anchor at one end of the elongated element, for holding the element in a hole and a tensioning arrangement at the other end of the element for use in tensioning the elongated element in the hole. The anchor is preferably a wedge anchor and the invention extends to a method of anchoring the rock anchor in a hole by means of a rod which is passed up into the elongated element from the mouth of the hole to tension the elongated element and activate the wedge anchor to lock the anchor against the side of the hole to hold the elongated element in the hole under tension. The invention also includes a method of grouting the rock anchor into the hole by pumping grout into the elongated element passage and from the passage through the slots between the tension members into the hole.

15 Claims, 4 Drawing Sheets

ROCK ANCHOR

FIELD OF THE INVENTION

This invention relates to an anchor bolt for use in preventing strata separation in mines and tunnels and more particularly to a bolt which is to be full column grouted into the hole in which it is to be located in use. To provide both immediate temporary support and when full column grouted a permanent active support.

In this specification the term grout is not limited to cementitious materials only and may include resins and any other settable material which is suitable for bolt anchoring.

BACKGROUND TO THE INVENTION

Rock anchor bolts which include a hollow rod having a hole at or near their ends which are located in a hole and through which grout can be pumped to fill the holes are known. A problem with this type of bolt is, however, that there is litle or no indication of whether the bolt is fully grouted in its hole or not and it certainly happens that bolts which are thought to be full column grouted are dangerously not. A further problem with conventional rock anchors which employ mechanical expansion heads is that it is frequently difficult to engage the unexpanded anchor shells of the heads at a particular position in the holes by merely rotating the bolts to expand the heads so that difficulties are frequently experienced in locating the bolts precisely in the holes which are to house them. This is particularly so in hard rock in which the wall of the hole is smooth.

A vast number of anchor bolts are employed daily in mining and tunneling operations and their expense adds signifcantly to the mining and tunneling costs. Most known anchor bolts are tensioned in use by means of a nut which is pulled up against whatever is anchoring the rod of the bolt in the hole on a threaded end of the bolt against a washer at the mouth of the hole. Bolt threading and the provision of a nut together contribute signifcantly to the cost of the bolts. Additionally, the effective cross sectional area of an anchor bolt rod and so its tensile strength is reduced by thread cutting. This reduction in the effective cross sectional area of a bolt results in expensive waste material. To overcome this problem the ends of some bolts are upset or rolled to a larger diameter than the remainder of the bolt with the threads then being rolled into the upset portion of the bolt. Although this procedure results in less waste bolt material the cost saving is largely negated by the cost of upsetting or rolling the bolts. Another bolting problem caused by thread tensioning arrangements is that of ensuring that a bolt is correctly tensioned. As is well known, approximately 90% of the torque applied to a tensioning nut is employed in overcoming friction, 50% at the bearing face of the nut on the roof washer and 40% between the mating bolt and nut threads. This results in only 10% of the applied effort being employed in axially loading the bolt and not even in this figure is certain.

Yet another problem with most conventional rock anchor bolts which employ expansion heads for point anchoring is that when locked into the hole, any attempt to withdraw the rod from the hole tends more firmly to wedge the anchor head in the hole. The result of this is that the bolt snaps when stretched beyond its elastic limit. This is a particularly serious problem in deep level gold mines where closure of the hanging and footwalls is inevitable and in seismic generated rockbursts.

OBJECT OF THE INVENTION

It is the object of this invention to provide an anchor bolt which will at least minimise the above problems with conventional bolts.

SUMMARY OF THE INVENTION

A rock anchor according to the invention includes an elongated element which is composed of a plurality of elongated tension members which are arranged around the long axis of the elongated element in a spaced relationship to define between them a passage through the elongated element on its axis, an anchor at one end of the elongated element for holding the elongated element in a hole and a tensioning arrangement at the other end of the element for use in tensioning the elongated element in the hole. Preferably the tensioning elements are strips of suitable steel.

In one form of the invention the elongated element includes two tension element strips which are each arcuate in cross section.

In another form of the invention the elongated element includes three strips which are rectangular in cross section and are, in cross section, arranged in the form of an equilateral triangle around the axis of the elongated element.

In yet further forms of the invention the strips may be circular in cross section or even be composed of wire ropes.

Further according to the invention the anchor includes a terminal head portion of the elongated element and at least two tapered members with one located in the elongated element passage and the other movable relatively to and against the first in the axial direction of the elongated element from within the passage to increase the radial dimension of the head portion of the elongated element in use.

Conveniently each tension member in the anchor head portion of the elongated element is outwardly stepped from the remainder of the member so that the cross sectional area of the elongated element passage which is circumscribed by the tension members in the anchor head portion of the elongated element is greater than the cross sectional area of the remainder of the passage through the elongated element.

In one variation of the rock anchor the anchor includes three tapered members with a first of the members being located in the elongated element passage and tapering inwardly from the free end of the anchor head portion of the elongated element towards its other end and the axis of the passage through the elongated element with the remaining tapered members being shells on the outside of the elongated element with each shell including a tapered formation which passes through a space between two of the tension members to be located in the elongated element passage in the head portion of the element below the first tapered member so that pressure on the shell formations from within the elongated member passage in the axial direction of the element will cause the shells to move towards and radially outwardly on the first tapered member.

In a preferred variation of the rock anchor the anchor includes a first elongated tapered member in the elongated element passage in the anchor with its taper inwardly towards the free end of the anchor head and the axis of the passage through it, a plurality of secondary tapered members which are engaged with the tapered portion of the first member and means on the tension members to limit movement of one or each secondary member towards the end of the elongated member so that movement of the first tapered member from within the passage of the elongated element towards the free end of the elongated element against the secondary members will cause the anchor head portion of the elongated members to expand radially.

In one variation of the tension arrangement of the rock anchor a portion of the length of the elongated element from its end opposite the anchor head is threaded and the tension arrangement includes a nut which is engaged with the threaded end of the element and a washer on the element above the nut.

Preferably, however, the tensioning arrangement is a formation which projects radially from and adjacent the end of the elongated element and which in use bears on a washer on the elongated element above the formation. Conveniently each of the tension members is bulged radially outwardly to provide the radial projection.

To rigidify the assembled lower end of the elongated element against inward radial deformation a reinforcing ring is located within the passage through the elongated element between the bulged portions of the tension members with the internal diameter of the ring being at least greater than the diameter of the passage through the elongated element. Each of the tension members may be bent outwardly below its outward bulge to form a saddle with the rock anchor including a ring which surrounds the elongated element in the tension member saddles to hold the elongated element assembly together.

A method of tensioning a wedge activated rock anchor as described above according to the invention includes the steps of locating the elongated element in a hole with its anchor head portion towards the blind end of the hole, locating a metal rod in the passage of the elongated element from the outside of the hole to abut a tapered member in the head portion of the elongated element and hammering the rod from the outside of the hole to cause the elongated element to move into the hole until the tensioning arrangement on the outside of the hole abuts material surrounding the mouth of the hole and to cause, by further hammering on the rod, the tapered members of the anchor head to expand the head portion of the elongated member radially into gripping contact with the wall of the hole to anchor the head in the hole and hold the elongated element in tension between it and the tensioning arrangement.

A method of grouting a rock anchor as described above in a pre-drilled hole according to the invention includes the steps of locating the elongated element in the hole with the anchor towards the blind end of the hole, tensioning the elongated element in the hole between the anchor and the tensioning arrangement at the mouth of the hole and pumping grout into the passage of the elongated element to escape under pressure from the elongated element through the spaces between the tension members into the hole surrounding the elongated element. Preferably the method includes the steps of feeding a tube into the elongated element passage until its end in the passage is adjacent the anchor and pumping grout under pressure through the tube progressively to fill the elongated element passage and the hole surrounding the element as the tube is withdrawn or expelled by the grout pressure from the elongated element passage.

BRIEF DESCRIPTION OF THE DRAWINGS

Embodiments of the rock anchor of the invention are now described by way of example only with reference to the drawings in which.

DETAILED DESCRIPTION OF THE ILLUSTRATED EMBODIMENTS

Figure 1:
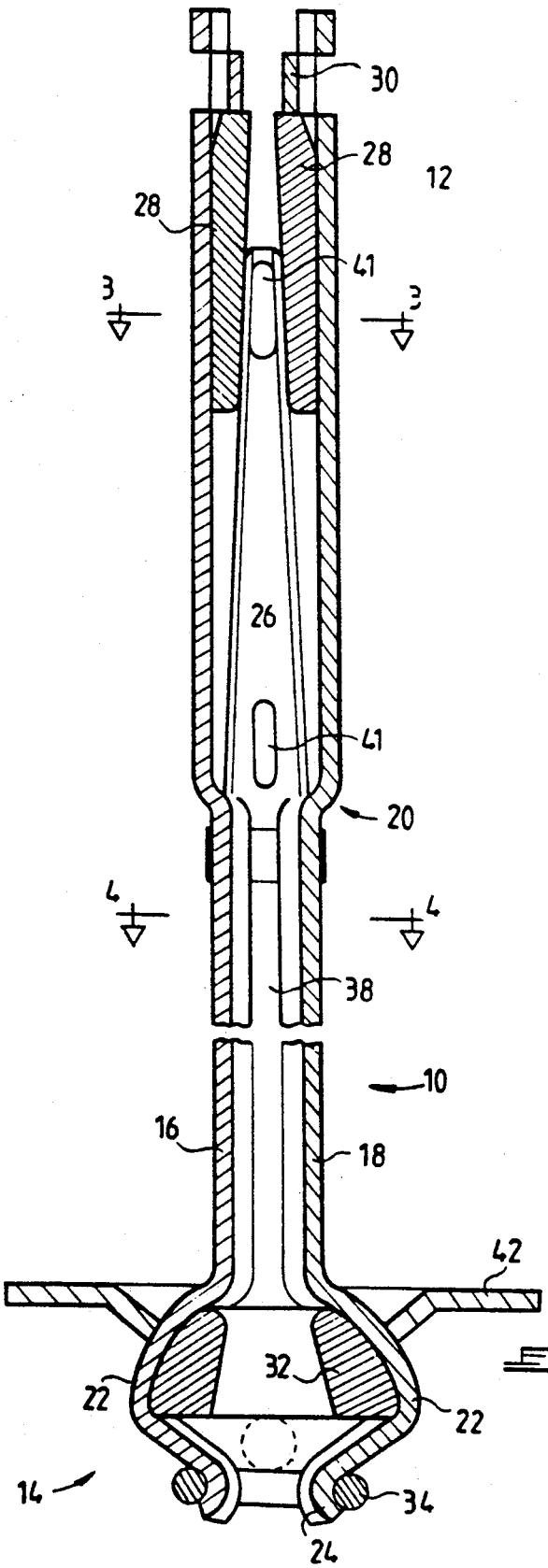
FIG. 1 is a sectioned side elevation of the preferred embodiment of the anchor bolt of the invention.

The preferred embodiment of the bolt of the invention is shown in FIG. 1 of the drawings to consist of an anchor rod indicated generally at 10, an anchor head 12 and a tensioning arrangement 14.

Figure 3:
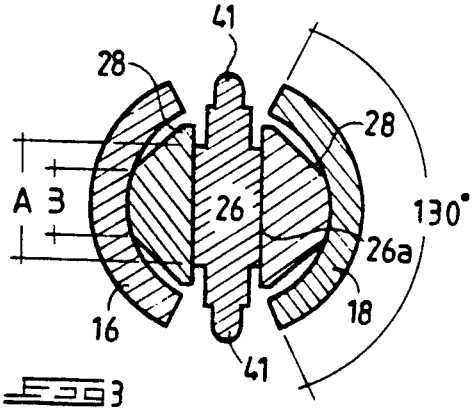
FIG. 3 is an enlarged end elevation of the FIG. 1 bolt shown sectioned on the line 3—3 in FIG. 1.
Figure 4:
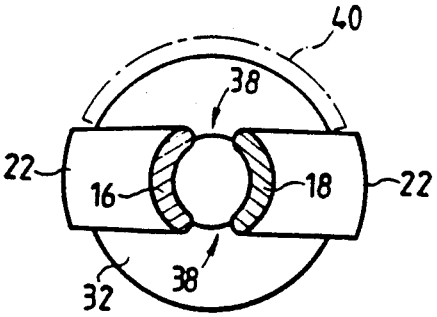
FIG. 4 is yet another sectioned end elevation of the bolt shown sectioned on the line 4—4 in FIG. 1.

The rod 10 is composed of two elongated members 16 and 18 which are, as is more clearly seen in FIGS. 3 and 4, arcuate in cross section and are made from a material having a combined cross sectional area for any given strength of material to provide the rod with a tensile strength to withstand whatever the desired load capability of the bolt is to be.

Figure 2:
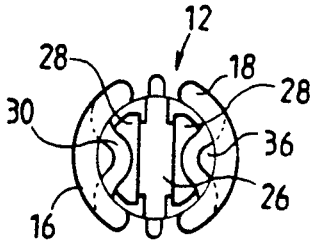
FIG. 2 is an end elevation of the bolt of FIG. 1.

The arcuate members 16 and 18 are manufactured directly from billets by hot rolling the metal into strips having the arcuate form shown in FIGS. 2, 3 and 4. The arcuate strips are then cut to whatever the design lengths of the bolts are to be. The upper ends of the strips are then pressed to be outwardly stepped at 20 to provide the anchor head portion of the bolt and their lower ends outwardly bulged as shown at 11 in FIG. 1 to provide between the two bulges the tensioning arrangement 14. The lower ends of the members are outwardly belled to provide ring saddles 24.

The anchor head portion 12 of the anchor bolt includes a primary wedge 26 and two secondary wedges 28. The three wedge elements of the anchor head have flat abutting faces with the included angle between the faces of the wedge 26, in this embodiment, being between 4° and 6°. The primary wedge 26 is loosely located in the anchor head between the secondary wedges 28. Upward movement of the secondary wedges 28 in the anchor head 12, from the position illustrated in the drawing, is prevented by stops 30 which are inwardly punched from the material of the elongated members 16 and 18 during press forming of the outwardly stepped anchor head portions and the bulges 22 of the members.

As is seen from FIG. 3 the primary wedge 22 includes two outwardly projecting wedge faces 26*a* which bear on the full width inclined wedge faces of the secondary wedges 28. It is important to the invention that the wedge faces 26*a* of the wedge 26 taper from the upper end of the wedge inwardly towards each other and the lower end of the wedge. The secondary wedges in turn bear on the elongated members over an area defined by their longitudinal contact surfaces with the members and the width dimension B. The relevance of the dimensions of the width A of the wedge faces 26*a* and secondary wedge dimension B will be further explained hereinafter.

The tensioning arrangement 14 includes a metal ring 32 which is located between the outwardly bulged portions 22 of the members 16 and 18 and a ring 34 which is engaged in the ring saddle formations on the members below the bulges 22, as shown in FIG. 1.

The anchor bolt is assembled by first engaging the ring saddles of the members 16 and 18 in the ring 34 and then moving the two members together as shown in the drawings. The primary wedge 26 is then loosely located in the anchor head portion 12 of the bolt with the flat faces of the secondary wedges 28 lying against the upper portions of the wedge faces 26*a* of the wedge 26 and against the stops 30 as shown in the drawing. A suitable tape may then be wrapped around the rod 10 directly below the head to hold the assembly together or a U-shaped steel clip may be engaged in apertures 36 of the stops 30, over the wedges, in the anchor head for the same purpose.

As a safety feature the U-shape steel clip mentioned above could be made of a suitable material or be dimensioned to open out and allow the elongated members 16 and 18 to separate transversely only under a predetermined force imposed on the wedge components in the head of the bolt. Alternatively, the head portion 12 of the bolt could be held together by a circumferential metal band or clip for the same purpose. With this arrangement there is certainty that the bolt has been anchored by the correct method and not merely located in an anchor hole and tapped into place with a heavy object.

It is essential to the invention that with the bolt assembled as shown in FIG. 1 that slots 38 extend over the length of the bolt between the elongated members 16 and 18. To hold the members 16 and 18 against circumferential displacement the reinforcing ring 32 could include two opposite outwardly projecting surfaces 40, as shown by chain lines in FIG. 4, to abut against the sides of the outwardly bulged portions 22 of the elongated members to prevent one member from rotating on the ring towards the other and so closing one of the slots 38 between the two members. The primary wedge 26 also includes ears 41 which project into the slots 38 to prevent the wedge assembly in the anchor head from rotating relatively to the rod 10 and also to prevent the primary wedge from skewing from the slots 38 in the anchor head by coming into contact with and digging into the sides of the hole in which the bolt is to be used.

In use, a domed washer 42 is slid onto the bolt from its headed end to rest on the outwardly bulging portions 22 of the rod 10. In some applications the washer 42 may be unnecessary with the bulged portion of the rod serving as the only tensioning arrangement at the mouth of the hole. The bolt is then slid into a pre-drilled hole with the anchor head 12 towards its blind end until the washer 42 abuts against the rock surrounding the mouth of the hole. As will be appreciated from FIG. 1 the washer 42 rides on the bulges 22 of the elements 16 and 18 to cater for any non-perpendicularity of the hole relatively to the face in which it is drilled or irregularities in the material of the face at the mouth of the hole. The degree to which the washer 42 can be inclined relatively to the bolt axis is dependent on the diameter of the hole through the washer within obvious limits. A striker rod from a jack hammer or a hydraulic ram is now pressed into the passage of the rod 10 between the elongated members 16 and 18 until its upper end abuts the underside of the primary wedge 26. The jack hammer is now activated to drive the wedge 26 upwardly in the anchor head 12.

Initially, the force acting on the wedge 26 will drive the wedge up between the wedges 28 to spread the wedges 28 and the elongated members apart until the outer surfaces of the elements 16 and 18 come into frictional contact with the wall of the hole. Continued operation of the jack hammer now drives the primary wedge further up between the almost set wedges 28. At this stage of bolt location the principal energy component imposed on the primary wedge is a driving energy which tensions the bolt against the friction between the outer surfaces of the members 16 and 18 and the wall of the hole and the tensioning arrangement 14. When the wedges become locked all of the energy imposed on the wedge system is transmitted laterally through the wedges 28 and the elongated elements in the bolt head to the wall of the hole to anchor the tensioned bolt in the hole. The force acting on the primary wedge is now balanced by the lateral force. As the wedge system of the bolt can now no longer absorb the applied energy, the end of the striker rod, when operated by a hammer, merely bounces on the wedge 26 to emit a ringing sound which indicates to the operator that the bolt is fully locked in the hole.

In the wedge system of the invention it is important that the wedge angle is below the critical angle of friction of the material from which the wedges are made and while the tangent of the wedge angle is less than the coefficient of friction of the materials the wedge system will not be caused to slip by the lateral anchoring faces imposed on it. The purpose of tapering the faces 26*a* of the wedge 26 from top to bottom is further to ensure that the plastic deformation of the wedges, under the high load forces imposed on them, will cause the wedge faces 26*a* to be slightly embedded in the faces of the wedges 28 in a dove tail like configuration the edges of which will prevent downward movement of the wedge 26 relatively to the wedges 28.

The pull out load of the bolts from the holes in which they are anchored may be made variable by varying the width B of the contact surfaces of the secondary wedges 28 with the inner surfaces of the elongated members. For example, a reduction in the dimension B will increase the point load effect of the wedges on the elongated members and so on the inner wall of the hole resulting in a greater pull out load than would be necessary with a greater wedge dimension B. Thus by varying the face width A of the wedge 26, the included angle between the mating faces of the wedges 26 and 28 and the dimension B of the secondary wedges a large degree of variation is possible in bolt tension and pull out force with this the preferred embodiment of the bolt of the invention.

With the bolt now firmly located and tensioned in its hole a tube, which is preferably made from a flexible plastics material, is fed up the passage in the bolt until its end in the bolt is adjacent or just short of the base of the primary wedge 26. Grout or another suitable settable material such as resin is pumped under pressure through the tube and from the slots 38 between the elongated members of the rod 10 into the hole surrounding the rod and into whatever fissures there may be leading from that area of the hole into the surrounding rock. Continued pumping of the grout under pressure will slowly force the tube down the bolt passage and progressively fill the surrounding hole through the slots 38 as the tube is slowly expelled by the back pressure of the grout acting on it. When the tube is eventually pressed by the grout from the bolt passage there can be little doubt that the bolt is fully surrounded, by whatever settable material has been pumped into the bolt, over its entire length in the hole.

With the anchor bolt firmly anchored as a permanent support an eye for lacing cables may be engaged with the bolt between the base of the reinforcing ring 32 and the ring 34 as shown in dotted lines in FIG. 1. The lacing eye may be of any suitable shape and when used in conjunction with the bolt of the invention the need for separate lacing eye anchors, as is conventional mining practice, is eliminated.

Figure 5:
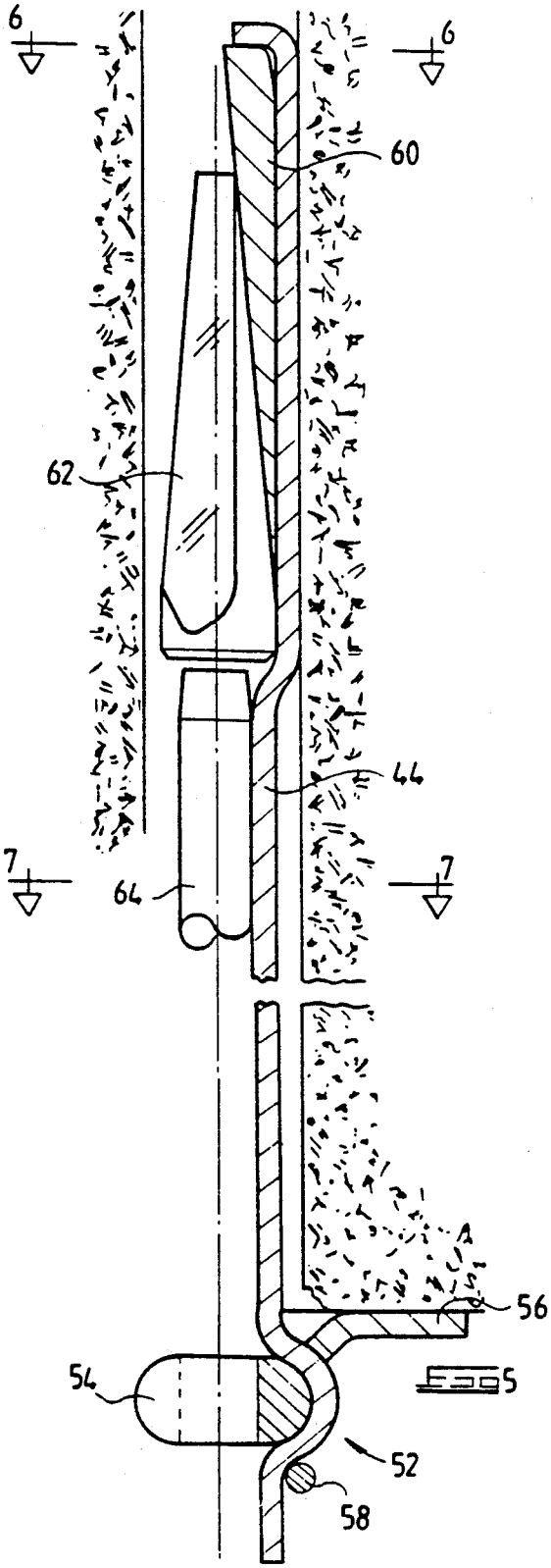
FIG. 5 is a half sectioned side elevation of a second embodiment of the anchor bolt of the invention.
Figure 6:
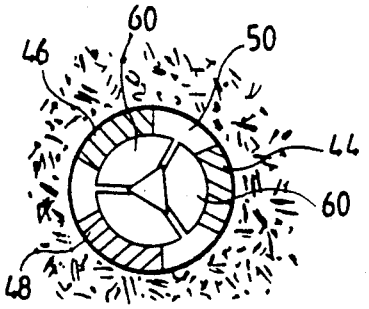
FIG. 6 is a plan view of the FIG. 5 bolt shown sectioned on the line 6—6 in FIG. 5.
Figure 7:
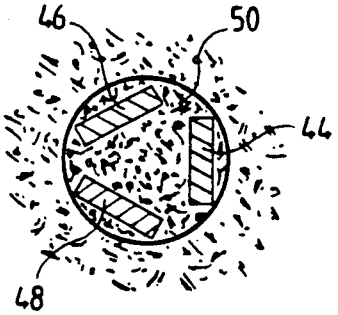
FIG. 7 is a plan view of the FIG. 5 bolt shown sectioned on the line 7—7 in FIG. 5.

In the FIG. 5 embodiment of the bolt of the invention the elongated tension members are, as seen in FIG. 7, flat steel strips 44, 46 and 48 with grout escape gaps 50 between their longitudinal edges of each of the strips. Each of the strips is pressed to be slightly arcuate over the length of the anchor head portion of the bolt, as seen in FIG. 6, and in the zone of the bulbous stop 52 at the other end of the bolt. As with the FIG. 1 embodiment of the bolt, the tensioning arrangement of this embodiment of the bolt carries a reinforcing ring 54 and a roof washer 56. It will be noticed that in this embodiment of the tensioning arrangement of the bolt the reinforcing ring 54 is a different shape to that shown in FIG. 1. Although the FIG. 1 arrangement is preferable the ring 54 is shown in this illustration merely to indicate that the tensioning arrangement of the bolt of the invention could have many forms within the scope of this invention. In this embodiment of the bolt a ring 58 is welded to the elongated members of the bolt below the outwardly bulged portion of the members to hold the lower end of the bolt together and to reinforce the bolt against spreading radially outwardly under load.

The anchor head of the bolt in this embodiment of the invention includes three secondary wedge shaped elements 60 which bear up against the arcuate portions of the strips 44 to 48 in the anchor head zone of the elongated elements with the folded over upper portions of the elements holding the secondary wedges in place in the head.

The anchor head additionally carries a movable primary wedge shaped member 62 which is substantially triangular in cross section with its flat faces resting on the flat inclined faces of the secondary wedges 60 and which is, in use, driven by a jack hammer striker rod 64 up between the secondary wedges 60 to tension the bolt and expand its anchor head into pressure contact with the wall of the hole in which the bolt is located in use.

Figure 8:
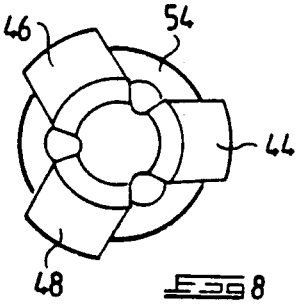
FIG. 8 is a view from below of the FIG. 5 bolt.

FIG. 8 illustrates the arrangement of the elongated elements 44 to 48 of the bolt over the reinforcing ring 54. In this drawing, the retaining ring 58 of FIG. 4 is omitted and the elongated members are shown welded together below the outwardly bulged portions of the elongated members to illustrate yet another method of holding the lower end of the composite bolt together.

Figure 9:
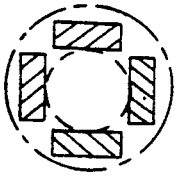
FIG. 9 is a sectioned plan view similar to that of FIG. 7 of a variation of the FIG. 5 bolt.
Figure 13:
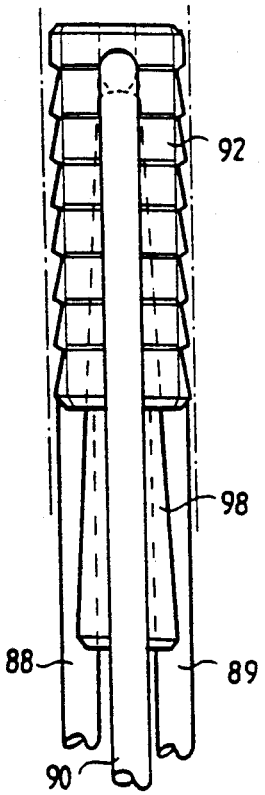
FIG. 13 is a side elevation of the anchor head of a fourth embodiment of the bolt of the invention.
Figure 15:
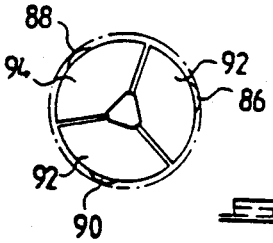
FIG. 15 is a plan view of the anchor head of the FIG. 14 bolt.
Figure 16:
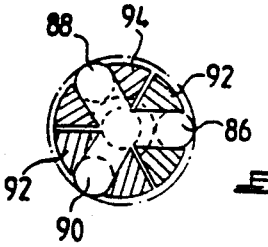
FIG. 16 is a plan view of the anchor head of the FIG. 14 bolt shown sectioned on the line 16—16 in FIG. 14.
Figure 17:
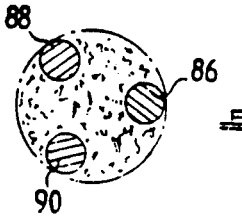
FIG. 17 is a plan view of the FIG. 14 bolt shown sectioned on the line 17—17 in FIG. 14.

FIG. 9 is a view similar to that of FIG. 7 of a bolt which includes four elongate tension members in place of the three of the FIG. 5 bolt. The anchor head configuration and the bulbous stop configuration of the opposite end of the bolt remain substantially the same as that of FIG. 5 except for four secondary wedges 16 which would now be necessary in place of the three illustrated in FIGS. 5 and 6 and a four faced primary wedge.

The FIG. 5 rock anchor of the invention is used in precisely the same manner as that described with reference to the FIG. 1 bolt.

Figure 10:
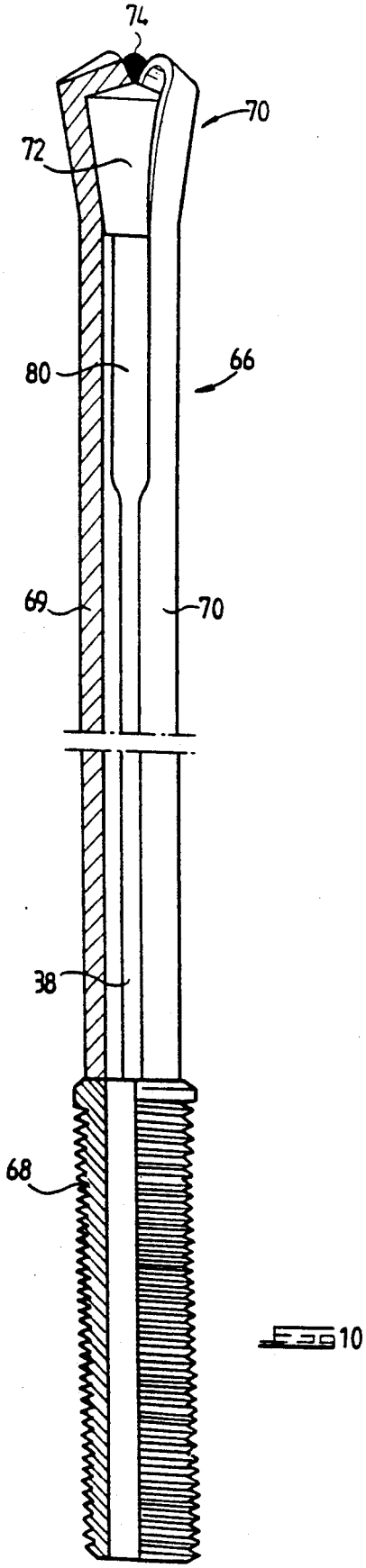
FIG. 10 is a half sectioned side elevation of a third embodiment of the anchor bolt of the invention.
Figure 11:
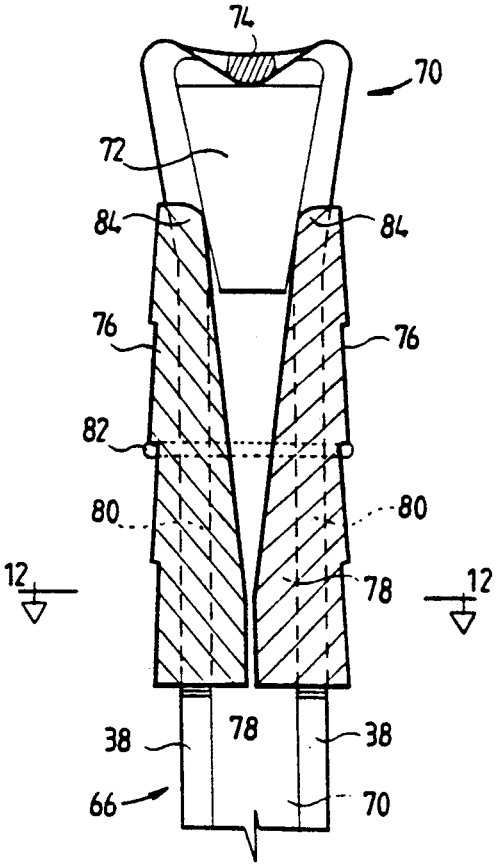
FIG. 11 is a sectioned side elevation of the anchor head of the FIG. 10 bolt.
Figure 12:
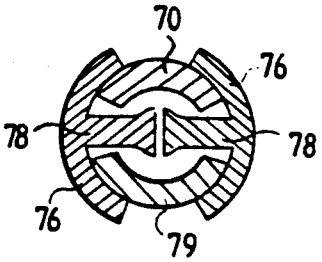
FIG. 12 is a plan view of the FIG. 10 bolt shown sectioned on the line 12—12 in FIG. 10.

The anchor rod of FIGS. 10 to 12 is shown in the drawings to include a rod 66, a threaded sleeve 68 which is welded onto the underside of the composite rod 66 and an anchor head 70.

The anchor rod 66, as with the FIG. 1 embodiment, is composed of two elongated members 69 and 70 which are arcuate in cross section.

The headed end of the rod 66 is outwardly belled to receive a frusto connical plug 72 which is held in place in the composite tube 66 by the ends of the belled portion of the tube being folded over and welded at 74 as shown in FIG. 11.

The anchor head 70 of the FIGS. 10 to 12 bolt carries, as is more clearly shown in FIG. 11, two expansion shells 76 which each include a centrally located radially inwardly projecting web 78. The webs 78 of the shells are located in the bolt passage and pass through the enlarged portions 80 of the slots 38 between the elongated members 69 and 70. The shells are held in place on the bolt prior to use by a wire spring clip 82 and by resting on the shoulders of the slots 38 where the slots are widened into the enlarged portions 80 in the head portion of the bolt.

This bolt is again used in the same manner as those of FIGS. 1 and 5 with the exception that the tensioning arrangement of the bolt includes a roof washer which is located over the threaded sleeve 68 and a nut which holds the washer in place on the bolt. In this embodiment of the bolt as the undersides of the webs 78 of the shells 76 are hammered by the jack hammer striker rod the bolt is moved forwardly in its hole to become tensioned against the mouth washer which bears on the tensioning assembly nut and then drives the leading noses 84 of the shells 76 in point contact up the sloping faces of the plug 72. As the shells are moved forwardly in the hole by hammering the sloping radially inward edges of the webs 78 ride up the plug 72 to move the shells radially outwardly and into engagement with the sides of the hole. At this stage the rod is fully tensioned between the tensioning assembly washer and the now locked shells 76. The jack hammer jumper rod is then removed from the anchor bolt and the bolt is grouted in the hole as described with reference to the FIG. 1 bolt.

In keeping within the object of the invention, the FIG. 10 bolt would obviously work as well as the bolts of FIGS. 1 and 5 if it had been equipped with tensioning assemblies such as those shown on the bolts of FIGS. 1 and 5. The threaded sleeve 68 is illustrated in this drawing merely to illustrate that a threaded tensioning arrangement, although not as economical as those of FIGS. 1 and 5 lies within the scope of this invention.

In the FIGS. 13 to 17 embodiment of the anchor rod of the invention the elongated tension members 86 to 90 are high tensile steel rods.

Figure 14:
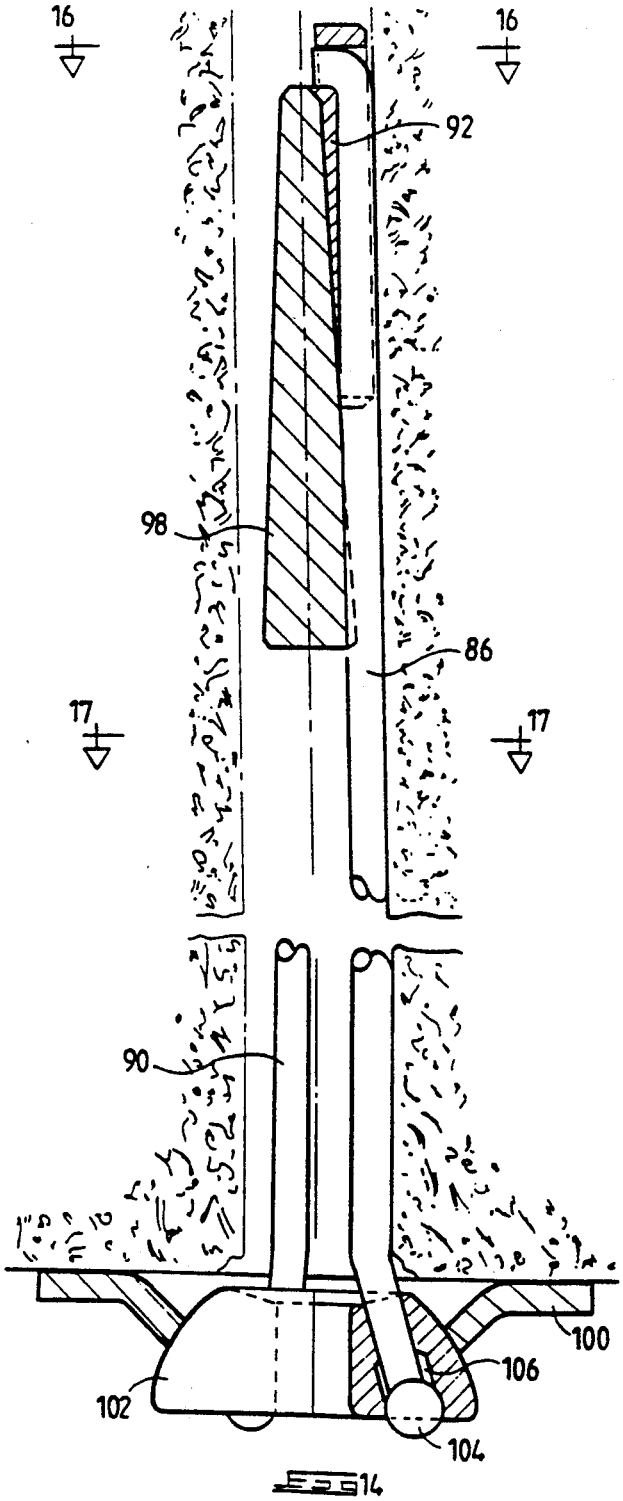
FIG. 14 is a fragmentary sectioned side elevation of the FIG. 13 bolt.

The anchor head of this embodiment invention consists of three wedge shaped elements 92, 94 and 96 which have serrated outer surfaces with each carrying a groove which extends upwardly from their lower ends over their outer surfaces to terminate in radially inwardly directed holes through the members. The rods 86 to 90 are located in the grooves on the wedges with their ends turned inwardly, as seen in FIG. 14, to be anchored in the holes at the upper ends of the wedges. It will be noticed, particularly from FIG. 15, that the rods stand slightly proud of the outer surfaces of the wedges 92 to 96 to provide a high pressure line contact with the wall of the hole when the triangular wedge shaped member 98, which is located between the three rods and the secondary wedges 92 to 96, is driven upwardly by a jack hammer striker rod to between the wedges 92 to 96 to expand the anchor head.

The tensioning arrangement at the mouth of the hole, in this embodiment of the bolt, consists of an outwardly domed washer 100 and an upwardly domed stop member 102. The stop member 102 includes an axially located bore for the grout tube and three outwardly inclined bores in which the ends of the rods 86 to 90 are located. The outer ends of the rods are upset to provide ball shaped formations 104 at the ends of the rods which are located in counter-sunk recesses at the outer ends of the rod bores. Secondary recesses 106, which are of a smaller diameter than the outer recesses, lead from the outer recesses into the bores so that when the anchor rod is properly tensioned to its designed tension the rod balls are pulled into the secondary recesses 106 to indicate to a mine overseer that the rod has been properly tensioned in its hole.

This anchor rod is tensioned and grouted in place in exactly the same manner as described with reference to the rods of FIGS. 1 and 5.

As has been previously mentioned the upper ends of the anchor rods of the invention are held together by a suitable tape which is bound tightly about the elongated tension members below the anchor head of the bolt. Naturally with long bolts the elongated members may be held together at spaced intervals by strips of binding tape or the like.

The anchor bolts of FIGS. 10 to 12 and FIGS. 13 to 17 have been described in this specification for example only and the preferred bolt of the invention is that illustrated in FIGS. 1 to 4 with the bolt of FIGS. 5 to 9 being largely untested but falling into the same category and having the same advantages over conventional bolts as that of FIGS. 1 to 4.

Not only to the bulbous tensioning arrangements of the FIGS. 1, 5 and 14 bolts provide a great economic saving over conventional threaded bolts by the elimination of a threading operation and the provision of a nut but the economics of hot rolling the elongated tension members from billet to form strips having the required cross section far outweigh the cost of a tubular rod or even a partially tubular type of rod. It must be emphasized, however, that the combined cross sectional area of the elongated tension elements of the anchor rods of the invention, for any given strength of material from which they are made, must be adequate to provide the anchor bolt with the design tensile load capability for which the bolt is designed. The wall thickness of the elongated members may be varied in dependance on the tensile strength of the metal from which they are made and the load which the bolt is required to carry in use.

Another advantage of the bolts of FIGS. 1 and 5 over conventional bolts is that increase in tension, due perhaps to rock burst conditions or deep level mine closure, is that the anchor heads of the bolts will tend to slip against the walls of the holes in which they are located under increased tension without loss of their load bearing capability to enable the bolts to yield as the load on them is increased even under sudden high velocity load impositions such as are experienced in rock burst conditions.

In an ungrouted condition the bolt of FIG. 1 has been found to work more than adequately as a temporary support in tunneling and mining operations. One of the big advantages of this bolt over known bolts is that after use for a period of time, perhaps in close proximity to blasting operations, the bolt may be again re-tensioned if necessary by jack hammer wedging as described above. With the bolts re-tensioned and when full column grouted as described above they have been found to be imminently suitable as permanent supports so eliminating the need in many rock anchoring applications of separate temporary and permanent rock bolt supports.

As examples of the efficacy of the FIG. 1 bolt two of the bolts were separately laboratory tested using a hydraulic test rig to anchor and tension the bolts in smooth walled metal tubes. Strain gauges were attached to the tensile members of the bolts to determine the resilient tension induced in the bolts when the wedge locking mechanism of the anchor heads were activated by a jack hammer and to test the pull out force of the bolts with the anchor heads locked. The following highly satisfactory results were obtained from the laboratory tests.

| | Laboratory Experiment | |
|---|---|---|
| Bolt No | Installation Pre-stress (Ton) | Pull out force value (Ton) |
| 1 | 1,442 | 11.020 |
| 2 | 1,324 | 11,340 |

It is anticipated that the pull out forces of the bolts in this laboratory test will have been even greater with the anchor heads of the bolts set in rock as opposed to the relatively smooth walled tube used in the laboratory tests. The pull out forces were well within the tensile limits of the material used to construct the elongated tension members 16 and 18 of the bolts.

With the laboratory tests on the bolts having proved highly satisfactory further tests were carried out in level 83 of the Western Areas Gold Mine in South Africa. Four 2,4 meter length bolts were strain gauged and tested. After installing the bolts, two of the bolts were grouted and two were left ungrouted, with only the wedge locking effect of the anchor heads active in the ungrouted bolts. In conducting the tests it was reasoned that the experiment would provide a good assessment of the anchor head locking efficiency of the bolts over a longer installation period, both with and without grouting. Pre-test readings were taken on installation and 14 days later and were tabulated as follows.

| On Site Installation Results | | | |
|---|---|---|---|
| Bolt No. | Installation Tension Ton | Tension 14 days active | State |
| 1 | 1,242 | Guages damage | Grouted |
| 2 | 1,563 | Guages damage | Ungrouted |
| 3 | 1,064 | 1,48 | Grouted |
| 4 | 1,104 | 1,33 | Ungrouted |

The strain gauges attached to bolts number 1 and 2 in the above table were damaged during mining operations and not by bolt performance. It will be seen from the table that the pre-stress value of the two bolts with the undamaged gauges actually increased over the test period. The increase was probably due to a very slight closure of the hanging with the footwall in the deep level mine in which the bolts were installed.

We claim:

1. A rock anchor, comprising: a composite anchor rod including an anchor head formed at one end of the composite anchor rod; wedge means, positioned within the anchor head, for expanding the anchor head into frictional engagement with a rock wall of a hole; tensioning arrangement means, positioned at an opposite end, opposite said anchor head, for preventing said opposite end from entering the hole and for providing a support structure against which said composite rod may be tensioned, said composite rod including a plurality of elongated tensioning members positioned substantially in parallel relationship around a central rod access, said tensioning members defining slots extending over a length of said composite rod between said anchor head and said tensioning arrangement means; and passage means defined by said tensioning members for receiving a settable member, said passage means including a rod passage extending through said tensioning arrangement means and said passage means communicating with the hole through said slots for allowing the settable material to surround the rock anchor.

2. A rock anchor as claimed in claim 1 wherein said tensioning members are strips formed of steel.

3. A rock anchor as claimed in claim 2 wherein said tensioning members include at least two strips which are each arcuate in cross section.

4. A rock anchor as claimed in claim 2 wherein said tensioning members include three strips which are rectangular in cross section and are, in cross section, arranged in the form of an equilateral triangle around the axis of the elongated element.

5. A rock anchor as claimed in claim 2 wherein said strips are circular in cross section.

6. A rock anchor as claimed in claim 1 wherein said anchor head includes a terminal portion of said tensioning members and said wedge means includes at least two tapered oppositely directed wedge shaped members with one located in said passage and the other movable relatively to and against said one in an axial direction of the rock anchor to act from within the passage to increase the radial dimension of the anchor head portion.

7. A rock anchor as claimed in claim 6 wherein each tensioning member in the anchor head portion of the composite rod is outwardly stepped from the remainder of each tension member so that a cross sectional area of said passage which is circumscribed by the tensioning members in the anchor head portion of the composite rod is greater than the cross sectional area of the remainder of the passage through the composite rod.

8. A rock anchor as claimed in claim 1 said wedge means includes three tapered members with a first of the members being located in said passage and tapering inwardly from the free end of the anchor head portion of the composite rod towards its other end and a central axis of said passage means with the remaining tapered members being shells on the outside of the composite rod with each shell including a tapered formation which passes through a space between two of the tensioning members and extends into said passage in the head portion, below the first tapered member, so that pressure on the shell formations from within the elongated member passage in the axial direction of the element will cause the shells to move towards and radially outwardly on the first tapered member.

9. A rock anchor as claimed in claim 1 wherein said wedge means includes a first elongated tapered member in said passage means in the anchor said first elongated tapered member having a tapered portion with a taper extending inwardly towards the free end of the anchor head and the axis of the passage through it, a plurality of secondary tapered members engaged with the tapered portion of the first member and limit means, on the tensioning members to limit movement of at least one of said secondary tapered members towards the end of the tensioning members so that movement of the first tapered member from within said passage means towards a free end of the tensioning members, against the secondary members, will cause the anchor head portion of the elongated member to expand radially.

10. A rock anchor according to claim 1, wherein each tensioning member of said composite rod includes an outwardly bulged portion adjacent an end of the composite rod, said anchor head being located opposite said outwardly bulged portion, holding means position between said tensioning arrangement and free ends of said tensioning members for holding said tensioning members together against spreading in a radial direction such that slots formed between said tensioning members provide a passage space which is at least as large as said passage means but which is smaller than the diameter of said metal ring.

11. A rock anchor according to claim 9, further comprising a retaining member for holding said composite rod tensioning members together, said retaining member including means for permitting a transverse separation of the tensioning members in the anchor head only upon the application of a predetermined force to the first tapered member in the anchor head.

12. A method for use with a rock anchor including a composite anchor rod, an anchor head at one end of the composite anchor rod and a holed tensioning arrangement at another end of the composite rod for preventing the another end of the composite rod from entering the hole, said tensioning arrangement providing support for tensioning the composite anchor rod, the composite anchor rod including a plurality of elongated tensioning members which are arranged around a rod access to defined slots which extend over the length of the composite anchor rod, between an anchor head and the tensioning arrangement, the tensioning members being provided around the rod access to define a passage, said passage being in communication with a hole provided in the tensioning arrangement, the anchor head including a terminal portion of the composite anchor rod and at least two tapered wedge-shaped members, one of said tapered wedge-shaped members being located in the anchor rod passage, another of said two tapered wedge-shaped members being movable relative to the one tapered wedge-shaped member in an axial direction of the anchor rod, from within the passage, to expand the anchor head portion laterally, comprising the steps of:

locating the composite anchor rod in a blind hole with the anchor head portion directed towards a blind end of the blind hole; positioning the tensioning arrangement against material surrounding a mouth of the blind hole;

locating a metal rod in the passage of the composite anchor rod from the outside of the blind hole, the metal rod passing through the passage in the tensioning arrangement and abutting the metal rod with the tapered member;

hammering the metal rod from the outside of the tensioning member passage to cause the one tapered member to ride up on the another tapered member in the axial direction of the composite rod to expand the anchor head portion of the composite rod laterally into frictional engagement with a wall of the blind hole to tension the composite anchor rod between the tensioning arrangement and the anchor head portion until the expanding anchor head is frictionally locked against the wall of the blind hole to hold the composite anchor rod in the hole under tension.

13. A method according to claim 12, further comprising the steps of: pumping grout under pressure into the passage of the composite rod to fill the passage such that the grout escapes from the composite rod through the slots formed between the tensioning members and fills the hole surrounding the tensioning members.

14. A method according to claim 13, further comprising the steps of: feeding a tube into the composite rod passage until an end of the tube is adjacent the anchor head of the composite anchor rod and pumping grout under pressure through the tube progressively to fill the composite rod passage and to fill the hole surrounding the anchor rod as grout passes through the slots between the tensioning members.

15. A rock anchor, comprising a composite anchor rod having one end with an anchor head and another end with a tensioning arrangement for preventing the another end from entering a rock hole, said tensioning arrangement providing support for tensioning the composite rod, said composite rod including a plurality of elongated tensioning members, each tensioning member being arranged around a central axis of the composite rod and defining slots between said tensioning members which extend over the length of the composite rod between the anchor head and the tensioning arrangement, said tensioning members surrounding a space defining a passage, said passage being in register with a hole extending through said tensioning arrangement; and, a first tapered wedge-shaped member and second tapered wedge-shaped member, the first tapered wedge-shaped member being located in said passage, said second tapered wedge-shaped member being movable relative to said first tapered wedge-shaped member and movable against said first tapered wedge-shaped member in an axial direction of the composite rod from within the passage, to expand the anchor head portion of the rock anchor laterally.

* * * * *